US005100064A

United States Patent [19]

Holzknecht

[11] Patent Number: 5,100,064

[45] Date of Patent: Mar. 31, 1992

[54] PROCESS FOR SEPARATING FOODS FROM THE PACKAGING

[76] Inventor: Wilfried Holzknecht, Brunnenweg 21, D-4425 Billerbeck, Fed. Rep. of Germany

[21] Appl. No.: 488,205

[22] Filed: Mar. 5, 1990

[30] Foreign Application Priority Data

Mar. 8, 1989 [DE] Fed. Rep. of Germany ..... 3907401

[51] Int. Cl.[5] ..... B02C 19/12

[52] U.S. Cl. ..... 241/14; 241/24

[58] Field of Search ..... 241/14, 23, 24, 18, 241/29, 30

[56] References Cited

U.S. PATENT DOCUMENTS 3,266,543 8/1966 Paoli ..... 241/14

3,346,199 10/1967 Strite ..... 241/14 X 4,500,040 2/1985 Steffens .

*Primary Examiner*—Timothy V. Eley

*Attorney, Agent, or Firm*—Felfe & Lynch

[57] ABSTRACT

A process for separating foods from packaging in which the foods are comminuted with the packaging by masticating and formed into a rope. The rope is cut and foods and packaging are subsequently separated by pressing the foods through a screen. Also, a device for working the process.

2 Claims, 2 Drawing Sheets

PROCESS FOR SEPARATING FOODS FROM THE PACKAGING

The invention relates to a process for separating foods from the packaging and a device for the working of this process.

Food which is not or no longer approved for consumption by humans and to be further processed into animal food is known to be manually separated form the packaging and to be comminuted.

This processing method, however, is very expensive such that foods which are not or no longer approved for consumption by humans must often be deposited on special waste disposal sites.

The foods concerned are those of faulty production, where the date of consumption has expired or which were imported although they did not comply with commercial regulations. Moreover, those foods are concerned which have no consumption dates but cannot be commercially traded anymore due to too a long storage, storage under improper conditions or due to other reasons.

It is an object of the invention to provide a process for a machine-operated further processing of said foods. This process should not only feature relatively simple machinery but it should also permit the processing of the most various kinds of foods while the portions of food adhering to the residual pieces of the package must be reduced to an insignificantly small amount.

The process in accordance with the invention must also be suited for processing foods which are not packaged like sausage with a natural casing or bread without wrapping. For the packaged food, however, the separation from the packaging must be so good as to ensure that the foods can be used as animal food.

This object is accomplished in accordance with the invention in that the foods are comminuted by masticating and formed into a rope. The rope is cut and package remainders and the foods are separated by pressing through a screen.

In order to support the separating effect, it is advantageous to introduce hot steam into the masticated mass before the pressing.

The device for accomplishing the object in accordance with the invention is advantageously characterized in that it is provided with a comminuting double screw extruder, a rotating multi-blade cutter and a screen head extruder.

Since the desired success can be achieved in a most simple way, this is an ideal solution to the problems posed.

In accordance with the invention a process for separating foods from packaging comprising comminuting foods with packaging by masticating and forming the foods into a rope, cutting this rope, and subsequently separating foods and packaging by pressing the foods through a screen.

Also in accordance with the invention, a device for separating foods from packaging comprises a comminuting double-head screw for masticating and forming foods into a rope, a rotating multiblade cutter for cutting the rope, and a screen head extruder for subsequently separating the foods and packaging.

For a better understanding of the invention, together with other and further objects thereof, reference is made to the following description, taken in connection with the accompanying drawings, and its scope will be pointed out in the appended claims.

Referring now to the drawings.

The process in accordance with the invention is carried out as follows:

The rigidly packed foods and the solid foods (e.g. hard smoked sausage) are masticated in a comminuter 12 by means of two electrically powered, counter rotating extruders 1 using squareedged screws which rip the packaging open and coarsely masticate solid foods. A multi-blade cutter 2 then further masticates the foods as a quasi homogeneous mass after the latter has passed through a plate having apertures 11 by means of an electrically powered conveying extruder.

Figure 1:
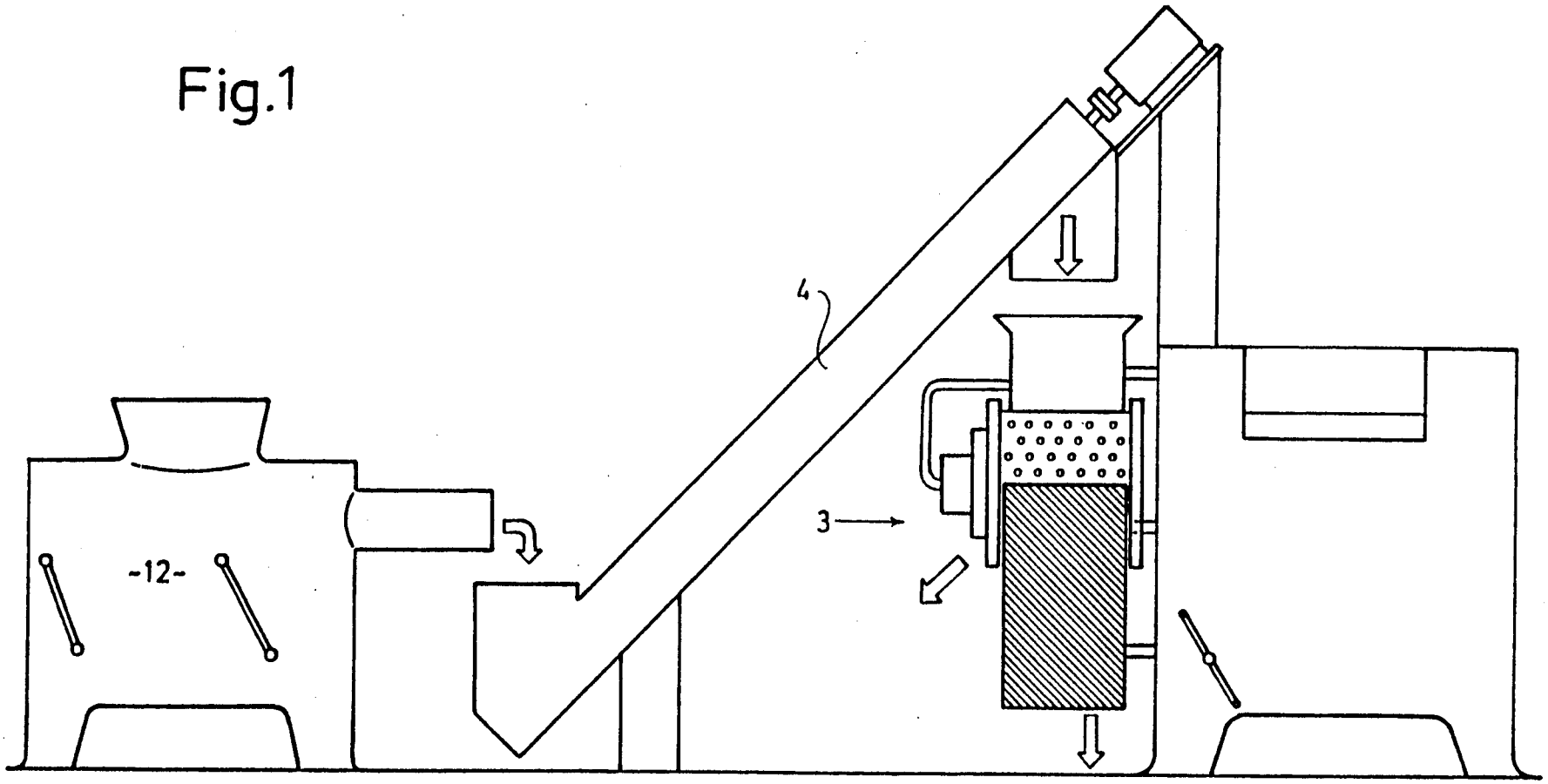
FIG. 1 is a diagrammatic representation of the design of the device in accordance with the invention.
Figure 2:
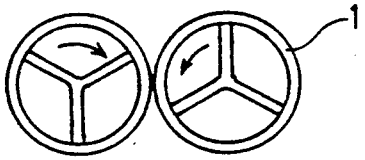
FIG. 2 is a section across the double screw extruder used.
Figure 3:
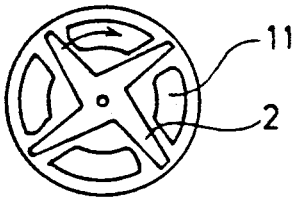
FIG. 3 is a section across the blade area of the comminuter.
Figure 4:
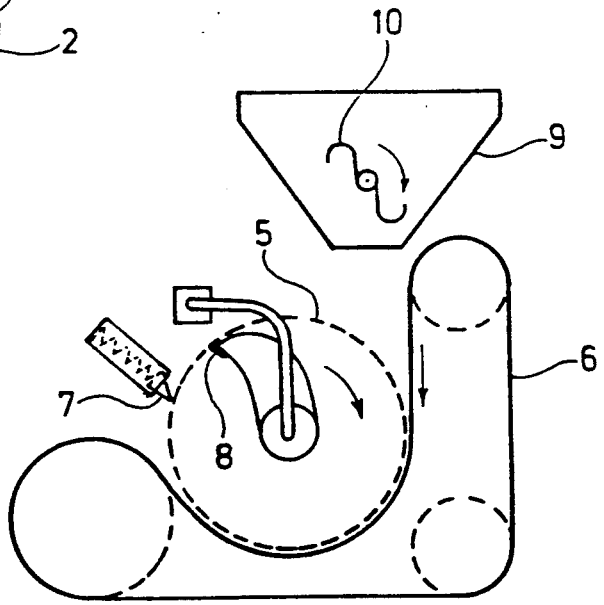
FIG. 4 is a diagrammatic side view of the screen-head extruder used.

As represented by the arrow from comminuter 12 in FIG. 1, the mass as a rope is then supplied to another electrically driven conveyor screw 4 at the beginning of which it is also possible to feed in foods in a soft packaging.

The conveyor screw has electrically driven conveyor elements 10 which discharge into a supply funnel 9. At this point, hot steam can be added for an improved separation of the foods from the packaging.

The mass is then supplied into a screen-head extruder 3 where it is continuously masticated between an electrically driven screen drum 5 and a separately electrically driven pressure belt. Separated from their packaging, the foods are thus pressed through the apertures of the drum into the interior whereas the packaging is retained at the external wall of the drum 5.

An external wiper 7 strips off the residual packaging from the external wall of the drum whereas the properly pressed through foods are recovered from the interior of the screen drum 5, which is open at one side, by means of an externally attached wiper 8.

The process can hence be carried with simple means without requiring a washing which consumes a great amount of energy.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Process for separating foods from packaging, comprising;

comminuting foods with packaging by masticating and forming the foods with packaging into a rope, cutting this rope, and subsequently separating foods and packaging by pressing the foods through a screen.

2. Process in accordance with claim 1, which includes introducing hot steam into the foods and packaging before the pressing.

* * * * *